US005826550A

United States Patent [19]

Paut

[11] Patent Number: 5,826,550

[45] Date of Patent: Oct. 27, 1998

[54] INTERNAL COMBUSTION ENGINE

[76] Inventor: Dražen Paut, Ivana Gundulića 28, Split, Croatia, 21000

[21] Appl. No.: 733,083

[22] Filed: Oct. 16, 1996

[30] Foreign Application Priority Data

Oct. 16, 1995 [HR] Croatia ..... P950518A

[51] Int. Cl.[6] ..... F02B 75/24

[52] U.S. Cl. ..... 123/55.5; 123/55.7

[58] Field of Search ..... 123/55.7, 55.5, 123/192.2, 54.1

[56] References Cited

U.S. PATENT DOCUMENTS 5,448,972 9/1995 Paut ..... 123/62

*Primary Examiner*—David A. Okonsky

*Attorney, Agent, or Firm*—Jacobson, Price, Holman & Stern, PLLC

[57] ABSTRACT

In an internal combustion engine comprising an engine block housing at least two reciprocating pistons being each provided in a cylinder comprising at least an inlet valve and an exhaust valve, which pistons are coupled with a crankshaft being coupled with a drive shaft and/or operating shaft, the at least two pistons are arranged in cylinders being placed at an angle of 90° C. to each other. Furthermore the crankshaft is coupled eccentrically with extensions of the pistons, which extensions are integral with the pistons and are protruding from the pistons opposite of the piston surface, and the drive shaft and/or operating shaft are coupled with the crankshaft with the same eccentricity.

9 Claims, 3 Drawing Sheets

INTERNAL COMBUSTION ENGINE

FIELD OF THE INVENTION

The present invention relates to an internal combustion engine comprising an engine block housing at least two reciprocating pistons being each provided in a cylinder comprising at least an inlet valve and an exhaust valve, which pistons are coupled with a crankshaft being coupled with a drive shaft and/or operating shaft.

Fields of technique to which the invention refers are:

automobile industry aviation shipbuilding stationary drive of generators, compressors etc.

compressors

DESCRIPTION OF THE PRIOR ART

In an existing engine of the above-mentioned type according to U.S. Pat. No. 5 448 972 when starting the engine by a driving wheel it could happen that a double piston reciprocating in coaxial chambers of a cylinder stops on the spot when it reaches the centre of the engine and the crankshaft, the operation shaft and the distributor or drive shaft rotate around their axes. In order to avoid that, the crankshaft of the known construction comprises a tooth and the engine block comprises a recess, which interlock with each other and throw the crankshaft out of the centre of the engine and together with it also the double piston, thus enabling the start of the engine.

SUMMARY OF THE INVENTION

It is therefore an object of the present invention to simplify the construction of an internal combustion engine of the above type so that it is no longer necessary to provide the crankshaft and the engine block with additional means for preventing a dead center position of the piston when starting the internal combustion engine.

It is a further object of the present invention to provide an internal combustion engine comprising fewer components, in particular fewer moving components, and thereby reducing the wear properties of the internal combustion engine.

For solving these problems there is provided an internal combustion engine comprising an engine block housing at least two reciprocating pistons being each provided in a cylinder comprising at least an inlet valve and an exhaust valve, which pistons are coupled with a crankshaft being coupled with a drive shaft and/or operating shaft, wherein the at least two pistons are arranged in cylinders being placed at an angle of 90° C. to each other, wherein the crankshaft is coupled eccentrically with extensions of the pistons, which extensions are integral with the pistons and are protruding from the pistons opposite of the piston surface, and wherein the drive shaft and/or operating shaft is/are coupled with the crankshaft with the same eccentricity.

It is essential for the present invention that the at least two pistons are arranged in cylinders being placed at an angle of 90° C. to each other resulting in a "V" or "X " construction, wherein the crankshaft passes through openings being provided in extensions of the at least two pistons, transforming the linear motion of the pistons into a circular motion of the crankshaft and furthermore of the drive shaft and the operating shaft. The inventive construction enables the manufacture of an internal combustion engine without any additional means for preventing a dead center position or alignment of the piston when starting the engine because each piston being arranged at an angle of 90° C. to the at least one further piston serves as a means of pushing the crankshaft out of the center and together with it also of the piston thus enabling the start of the machine.

According to a preferred embodiment of the present invention there is further provided an internal combustion engine, wherein the two pistons comprise an opening in their extensions which opening houses an eccentric part of the crankshaft, and wherein the cylinders are provided with two concentric openings functioning as bearings for the crankshaft and the operating and/or drive shaft. Such arrangement of the openings in the pistons or the extensions as well as in the cylinder walls allow an easy positioning of the crankshaft by defining exact bearings for the crankshaft being coupled eccentrically with the at least two pistons. Advantageously the pistons are built in one piece and the corresponding parts of the crankshaft are fitted into both sides of the openings of the pistons, which allows a simple and cost effective production of the piston wherein the crankshaft may be divided into several parts according to the number of cylinders used and may be easily fitted into the corresponding openings of the pistons or their extensions.

For further simplifying the design and construction of the inventive internal combustion engine it is proposed that two adjacent cylinders comprise at least partly a common cylinder wall comprising a common opening functioning as a bearing for the crankshaft. Such common cylinder wall being provided for adjacent cylinders allow a considerable reduction of the overall dimensions of the internal combustion engine allowing furthermore a considerable reduction of the total weight of the inventive internal combustion engine because of the reduction of the material used for producing the cylinders and the crankshaft.

For a further reduction of the overall dimensions of the inventive internal combustion engine for the same working volume and thereby a further reduction of the weight of the engine and a smaller number of the components it is advantageously proposed that the pistons are two-sided pistons reciprocating in two coaxial chambers each of a cylinder, each chamber being provided on opposite sides of the crankshaft and that the two-sided pistons each comprise a central bearing through which the crankshaft is passing. Such at least two two-sided pistons reciprocating in two coaxial chambers of a cylinder and being placed in the motor housing or motor block at an angle of 90° C. to each other provide a "X"-model with at least four combustion chambers, wherein by further providing openings in the pistons or their extensions, through which the crankshaft passes, a transformation of the linear motion of the two-sided pistons into a circular motion of the crankshaft and further on the drive shaft and of the operating shaft is possible. Such two-sided pistons or double pistons guarantee a longer life of the pistons and the cylinders owing to a greater contact surface of the pistons and furthermore they can be manufactured with existing technological standards and do not require special machines or tools.

According to a further preferred embodiment there is provided an internal combustion engine, wherein the opening for housing the crankshaft is arranged in a connecting part forming the extensions of the pistons and connecting the two piston heads of the two-sided pistons, allowing a further simplification of the design and construction of the inventive internal combustion engine.

For obtaining multiline engines it is furthermore proposed that more than two pistons and cylinders are coupled with a common crankshaft. Thereby by mutual coupling of several "X"-models when using two-sided pistons or "V"-models when using conventional pistons it is easily possible to obtain multiline engines. In this connection it is further proposed that a one-piece crankshaft is provided, allowing a further simplification of the construction.

Both above-mentioned constructions ("X" and "V") could be manufactured as:

gasoline or Diesel engine two-stroke engine-with using a compressor
using one chamber as operational (engine) and the other as the compressor compressor-mono-or multistage compressor with certain changes to the construction.

According to a further embodiment it is proposed that the crankshaft is coupled on one end with a drive shaft serving for driving auxiliary equipment of the engine, such as the cam shaft, oil pump, water pump, etc., and that the crankshaft is coupled on the other end with an operating shaft conveying power through a driving wheel to a consumer. For providing a light-weight construction the engine block and the cylinders and the pistons may be made of aluminium.

SHORT DESCRIPTION OF THE DRAWINGS

These and other characteristic features will become apparent from the following description of preferred, non-limiting examples of embodiments of the internal combustion engine according to the present invention being shown in the attached drawings, wherein FIG. 1 is a sectional view of a first embodiment of an internal combustion engine according to the present invention;

FIG. 2 is a side elevational view, partly broken away, according to arrow II of FIG. 1, wherein FIG. 1 is a longitudinal section along a longitudinal axis of one of the two-sided pistons;

FIGS. 3*a*–3*g* show a kinematic analysis of different stages of the movement of the two-sided pistons of the internal combustion engine being shown in FIGS. 1 and 2;

FIG. 4 is a side elevational view of a further embodiment of an internal combustion engine according to the present invention wherein single pistons are used; and FIG. 5 is a side elevational view of the piston being shown in FIG. 4 according to arrow V.

DETAILED DESCRIPTION OF THE PREFERRED EMBODIMENTS

Figure 2:
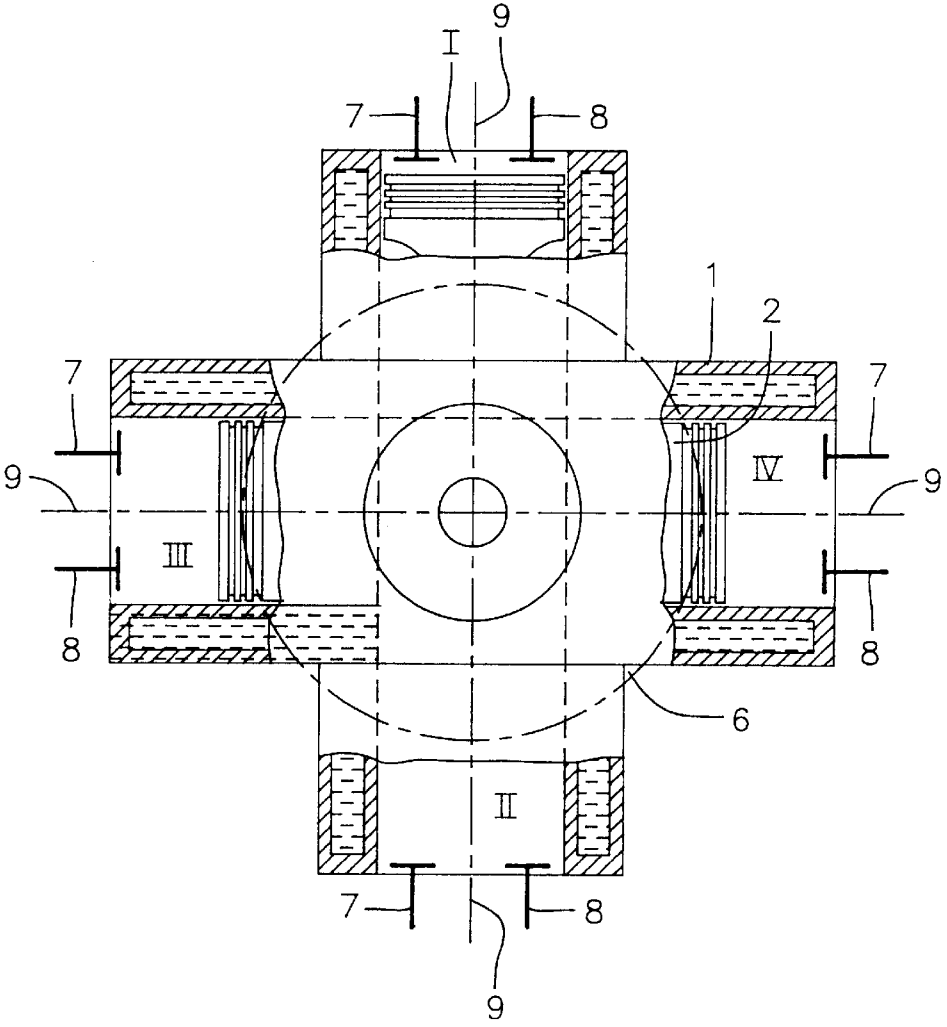
Figure 1:
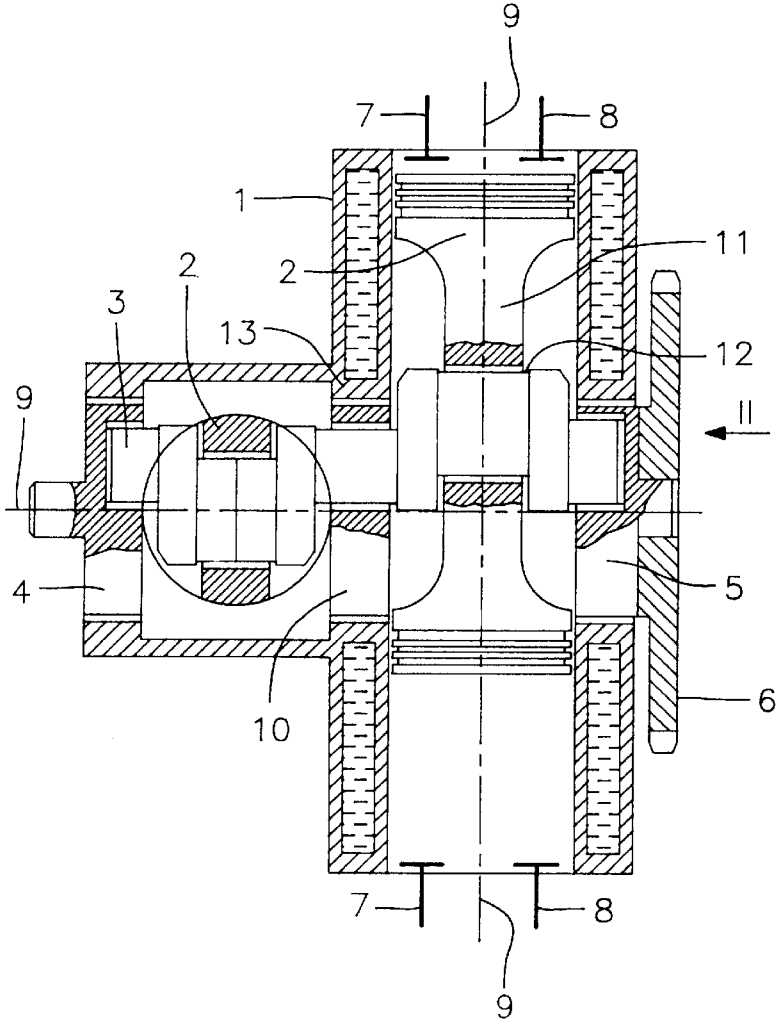

FIGS. 1 and 2 show a first embodiment of an internal combustion engine, wherein the engine structure comprises the following essential parts:

1. Engine block
2. Double pistons
3. Crankshaft
4. Distributor or drive shaft
5. Operating shaft
6. Driving wheel
7. Suction valves
8. Exhaust valves
9. Sparking plugs
10. Auxiliary bearings of crankshaft
11. Extensions or connecting parts of the pistons
12. Openings defining bearings for the crankshaft of the pistons
13. Common part of cylinder wall of adjacent cylinders I, II, III and IV chambers Black fields indicate bearings.

FIGS. 1 and 2 show an internal combustion engine comprising two two-sided pistons 2 being arranged at an angle of 90° C. to each other. The pistons 2 are arranged in two coaxial chambers I and II as well as III and IV of the cylinders being defined by the engine block 1. Between the pistons 2 there is provided a connecting part or extension 11 with a bearing defined by an opening 12 in the middle, through which a crankshaft 3 passes, which shaft is bearing mounted in the distributor or drive shaft 4 and the operating shaft 5. The crankshaft 3 is coupled with the piston 2 or the connecting parts 11 thereof with the same eccentricity e as with the drive shaft 4 and the operating shaft 5, which are mounted in concentric openings in the left and right side of the engine block shown in FIG. 1.

From FIGS. 1 and 2 there can be further seen that the two adjacent cylinders comprise at least partly a common cylinder wall 13 defining an auxiliary bearing 10 of the crankshaft 3. Furthermore it is shown that each chamber I,II, III and IV is provided with at least one suction valve 7, one exhaust valve 8 and one sparking plug 9.

Because of the fact that the two cylinders shown in FIGS. 1 and 2 together with the two two-sided pistons 2 are arranged at an angle of 90° C. to each other it is prevented that when starting the engine the pistons 2 together with the crankshaft 3 may reach a dead center position prohibiting any further movement of the pistons 2 and therefore of the complete engine. Several stages of the relative positions of singular elements of the engine being shown in FIGS. 1 and 2 are schematically indicated in FIGS. 3*a*–3*g*.

FIGS. 3*a*–3*g* show a kinematic analysis of the machinery as the schematic positions of machinery and courses of individual elements and points of machinery for a rotation of operation shaft 5 (or crankshaft 3) of 180° C.

Points: A and D-centre of two-sided piston 2, connection of piston 2 and crankshaft 3

B-eccentricity of crankshaft 3 and operating shaft 5

C and C'-centre of engine and operating shaft 5

Elements: 3-crankshaft

5-operating shaft

6-driving wheel

Figure 3A:
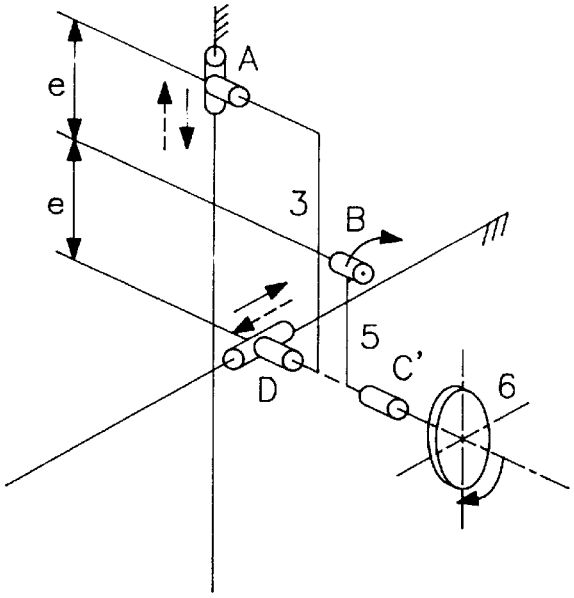
Figure 3B:
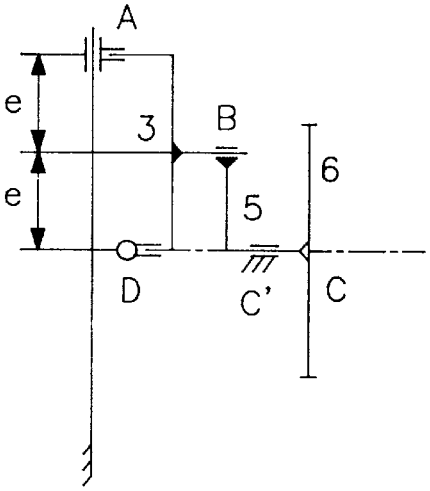
Figure 3C:
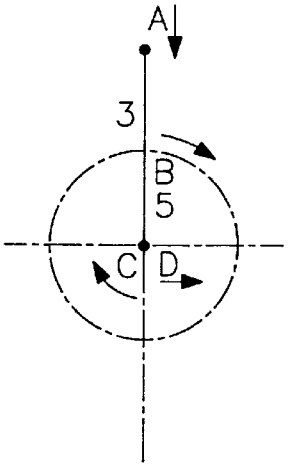
Figure 3D:
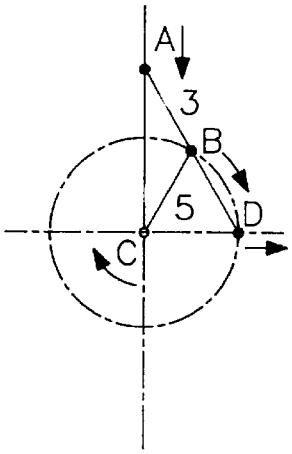
Figure 3E:
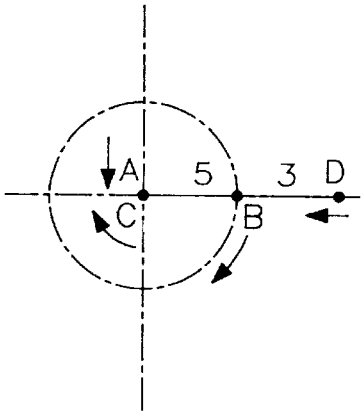
Figure 3F:
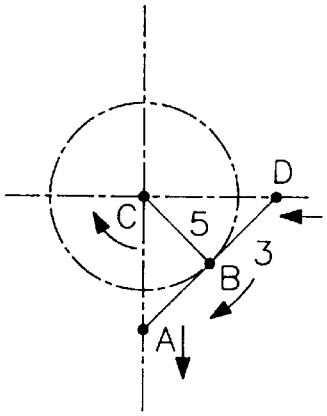
Figure 3G:
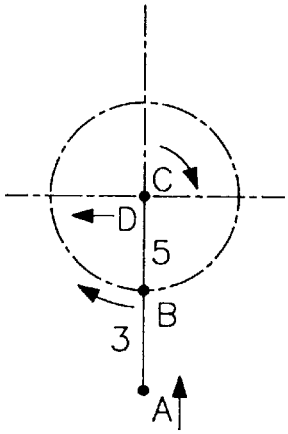

The kinematic scheme of the mechanism shown in FIGS. 3*a*–3*g* illustrates the paths of some members and points of the mechanism for the stroke of the two two-sided pistons 2 of 4*e*(e=eccentricity) and moreover of the operating shaft 5 and/or drive shaft 4 for 180° C. When the engine is started and one of the two-sided pistons 2 reaches the position as shown in FIG. 3*e*, the fact that the other piston is arranged at an angle of 90° C. prevents any blocking condition of the two-sided pistons 2 when starting the engine. Thereby such an arrangement of at least two cylinders in a "X" arrangement shall throw out the crankshaft 3 in longitudinal direction of the movement of the respective two-sided piston 2 from the center of the engine and also the piston 2 with it thereby avoiding any dead end position.

Depending on the construction, the two-sided pistons 2 can be made in one piece, in which case the crankshaft 3 is made of more segments or the manufacture of the two-sided pistons 2 of two pieces is possible, whereas the crankshaft 3 is made of one piece. The manufacture of the engine block 1 as one piece, two pieces or more is also possible.

FIGS. 1 and 2 show a two cylinder engine in a "X"-construction with two two-sided or double pistons 2 and four chambers I, II, III and IV. By coupling the crankshaft 3 with a drive shaft serving for driving any auxiliary equipment of the engine such as the cam shaft, oil pump, water pump or so one and by coupling the crankshaft 3 on the other end with an operating shaft 5 conveying power through a driving wheel 6 to a consumer, a very small and light-weight construction with only few moving parts can be achieved. By combining a larger number of cylinders which are arranged as is shown in FIGS. 1 and 2 multiline engines can be achieved.

Figure 4:
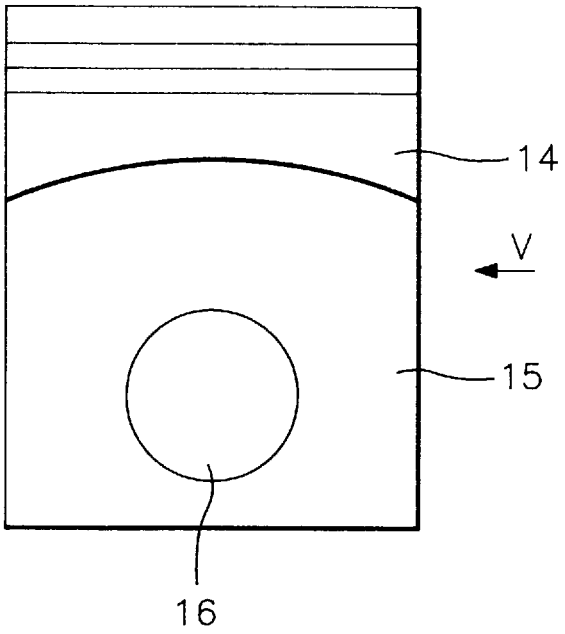
Figure 5:
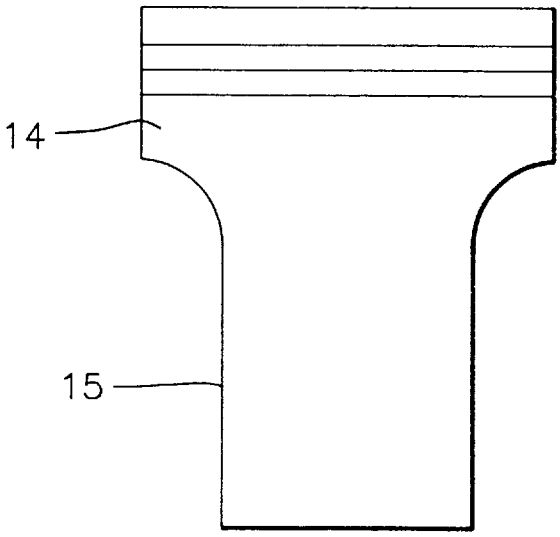

In FIGS. 4 and 5 another embodiment of pistons for an internal combustion engine is shown, wherein in contrast to the embodiment of FIGS. 1 and 2 only one-sided pistons 14 are used. These pistons are provided with extensions 15 comprising an opening 16 through which, as is shown in FIGS. 1 and 2, a crankshaft 3 passes for transforming a linear motion of the pistons 14 into a circular motion of the crankshaft 3 and a drive shaft 4 and/or operating shaft 5. Such one-sided pistons 14, being shown in FIGS. 4 and 5, are also positioned in cylinders arranged at an angle of 90° C. relative to each other, thereby providing a "V"-construction also preventing any dead center position or alignment of pistons 14 and the crankshaft 3 when starting the engine.

As with the embodiment shown in FIGS. 1 and 2 the pistons 14 and the extensions 15 may be built in one piece wherein the corresponding parts of the crankshaft 3 are fitted from both sides of the openings 16 of the pistons 14. Also when using one-sided pistons as shown in FIGS. 4 and 5 adjacent cylinders may comprise at least partly a common cylinder wall with a common opening and bearing for the crankshaft 3 as is shown in FIG. 1 for an embodiment comprising two two-sided pistons.

I claim:

1. Internal combustion engine comprising an engine block housing at least two reciprocating pistons each being provided in a cylinder comprising at least an inlet valve and an exhaust valve and a respective piston axis of the pistons being located in spaced parallel planes, said pistons being coupled with a crankshaft, said crankshaft being coupled with a drive shaft and an operating shaft, the at least two pistons being arranged in cylinders placed at an angle of 90° C. to each other, the crankshaft being coupled eccentrically with extensions of the pistons, said extensions being integral with the pistons and protruding from the pistons in a direction opposite to a piston surface, two adjusting cylinders including at least partly a common cylinder wall having a common opening with a bearing having the crankshaft eccentrically mounted in the bearing, and the drive shaft and the operating shaft being coupled with the crankshaft with a same eccentricity as the eccentric mounting of the crankshaft in the bearing so that crankshaft portions mounted in the drive shaft, the bearing and the operating shaft are aligned along a common longitudinal axis.

2. Internal combustion engine according to claim 1, wherein the two pistons comprise an opening in their extensions which opening houses an eccentric part of the crankshaft, and wherein the cylinders are provided with two concentric openings functioning as bearings for the crankshaft and at least one of the operating shaft and the drive shaft.

3. Internal combustion engine according to claim 2, wherein the pistons are built in one piece and wherein the corresponding parts of the crankshaft are fitted into both sides of the openings of the pistons.

4. Internal combustion engine according to claim 1, wherein the engine block and the cylinders and the pistons are made of aluminium.

5. Internal combustion engine according to claim 1, wherein the pistons are reciprocate in two coaxial chambers each of a cylinder, each chamber being provided on opposite sides of the crankshaft and wherein the two-sided pistons each comprise a central bearing through which the crankshaft is passing.

6. Internal combustion engine according to claim 5, wherein the opening for housing the crankshaft is arranged in a connecting part forming the extensions of the pistons and connecting the two piston heads of the two-sided pistons.

7. Internal combustion engine according to claim 1, wherein more than two pistons and cylinders are coupled with a common crankshaft.

8. Internal combustion engine according to claim 7, wherein a one-piece crankshaft is provided.

9. Internal combustion engine according to claim 1, wherein the crankshaft is coupled on one end with the drive shaft serving for driving auxiliary equipment of the engine, and wherein the crankshaft is coupled on the other end with the operating shaft conveying power through a driving wheel to a consumer.

* * * * *